US011442481B2

(12) United States Patent
Hsieh et al.

(10) Patent No.: US 11,442,481 B2
(45) Date of Patent: Sep. 13, 2022

(54) DIGITAL REGULATOR SYSTEM AND CONTROL METHOD THEREOF

(71) Applicant: NUVOTON TECHNOLOGY CORPORATION, Hsinchu (TW)

(72) Inventors: Chung Ming Hsieh, Hsinchu (TW); Ching-Yen Chiu, Hsinchu (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 156 days.

(21) Appl. No.: 16/818,362

(22) Filed: Mar. 13, 2020

(65) Prior Publication Data

US 2020/0293076 A1 Sep. 17, 2020

(30) Foreign Application Priority Data

Mar. 15, 2019 (TW) ..... 108108948

(51) Int. Cl.

| | |
|---|---|
| ***G05F 1/575*** | (2006.01) |
| ***G05F 1/56*** | (2006.01) |
| ***G05F 1/563*** | (2006.01) |
| ***G05F 1/59*** | (2006.01) |

(52) U.S. Cl.

CPC ..... *G05F 1/575* (2013.01); *G05F 1/561* (2013.01); *G05F 1/563* (2013.01); *G05F 1/59* (2013.01)

(58) Field of Classification Search

CPC . G05F 1/565; G05F 1/46; G05F 1/575; G05F 1/561; G05F 1/563; G05F 1/59; G05F 1/56; H02M 1/0045; H02M 1/0003; H02M 1/088; H02M 3/158; H02M 3/1584

See application file for complete search history.

(56) References Cited

U.S. PATENT DOCUMENTS

| | | | | |
|---|---|---|---|---|
| 10,185,338 | B1 * | 1/2019 | Lahiri | H03F 3/45179 |
| 10,389,224 | B2 * | 8/2019 | Huang | H02M 3/1584 |
| 2005/0242796 | A1 * | 11/2005 | Yang | G05F 1/575 323/282 |
| 2011/0148386 | A1 * | 6/2011 | Dhuyvetter | H02M 3/158 323/311 |
| 2012/0062192 | A1 * | 3/2012 | Okuma | G05F 1/56 323/272 |
| 2014/0285165 | A1 * | 9/2014 | Wang | G05F 1/56 323/274 |
| 2017/0212540 | A1 * | 7/2017 | Cho | G05F 1/56 |

* cited by examiner

*Primary Examiner* — Thienvu V Tran
*Assistant Examiner* — Shahzeb K Ahmad
(74) *Attorney, Agent, or Firm* — Muncy, Geissler, Olds & Lowe, P.C.

(57) ABSTRACT

A digital regulator system is provided. The digital regulator system includes a digital regulator circuit and a compensation circuit. The digital regulator circuit outputs an output current and an output voltage. The digital regulator circuit adjust the output current by decreasing or increasing a unit current according to at least a reference voltage and a feedback voltage. The compensation circuit receives the output voltage as well as decreases or increases a unit voltage of the output voltage to generate and output the feedback voltage according to the variation of the output current.

11 Claims, 4 Drawing Sheets

DIGITAL REGULATOR SYSTEM AND CONTROL METHOD THEREOF

CROSS-REFERENCE TO RELATED APPLICATION

This application claims the benefit of Taiwan Patent Application No. 108108948, filed on Mar. 15, 2019, in the Taiwan Intellectual Property Office, the disclosure of which is incorporated herein in its entirety by reference.

BACKGROUND

1. Field

The invention relates to a digital regulator system, more particularly to a digital regulator system with a compensation mechanism to improve convergence stability, and a control method thereof.

2. Description of the Related Art

In recent years, low-dropout linear regulators (linear dropouts, LDOs) have the advantages of high conversion efficiency, small size, and low noise, so they are widely used in various portable systems powered by batteries and communication related electronic products.

The low-dropout linear regulator includes an analog low-dropout linear regulator (analog LDO) and a digital low-dropout linear regulator (digital LDO). Digital low-dropout linear regulators have the advantages of low noise and adjustable output voltage, but their low convergence stability greatly affects their application fields.

SUMMARY

In order to solve the problems of prior art described above, an aspect of the invention is to provide a digital regulator system and a control method thereof. By adjusting the feedback voltage corresponding to the output current of the digital regulator circuit, the convergence stability of the digital regulator circuit can be effectively improved.

In order to achieve the above aspect, the invention provides a digital regulator system, which includes a digital regulator circuit and a compensation circuit. The digital regulator circuit outputs an output current and an output voltage. The digital regulator circuit adjusts the output current according to at least a reference voltage and a feedback voltage to decrease or increase the output current by a unit current. The compensation circuit receives the output voltage as well as decreases or increases the output voltage by a unit voltage according to the variation of the output current to generate and output the feedback voltage.

According to an embodiment of the invention, the digital regulator circuit further includes a first comparator, a second comparator, a control unit, and a plurality of current units. Each current unit outputs a unit current when the current unit is turned on. The control unit respectively turns on or turns off the plurality current units according to the comparison results generated by the first comparator and the second comparator, and the control unit outputs at least a unit current to generate the output current.

According to an embodiment of the invention, the control unit outputs a current adjustment signal to the compensation circuit, and the compensation circuit decreases or increases the unit voltage to the output voltage according to the current adjustment signal to generate and output the feedback voltage, wherein the current adjustment signal indicates that the control unit respectively turns on or turns off the plurality of current units to increase or decrease the unit current by the output current.

According to an embodiment of the invention, the positive input terminal of the first comparator receives the feedback voltage, the negative input terminal of the first comparator receives a first reference voltage, and the positive input terminal of the second comparator receives the feedback voltage, and the negative input terminal of the second comparator receives a second reference voltage, and the first reference voltage is larger than the second reference voltage.

According to an embodiment of the invention, the unit voltage satisfies the following conditions: $\Delta V>(V_{REF_H}-V_{REF_R})/2$; where $\Delta V$ is the unit voltage, $V_{REF_H}$ is the first reference voltage, and $V_{REF_R}$ is the second reference voltage.

According to an embodiment of the invention, an output terminal of the digital regulator circuit is coupled to a capacitor, and the unit current satisfies the following conditions: $\Delta I>(V_{REF_H}-V_{REF_R})\times C_p\times F_{SW}$; wherein $\Delta I$ is the unit current and $V_{REF_H}$ is the first reference voltage, $V_{REF_R}$ is the second reference voltage, $C_p$ is a capacitance value of the capacitor, and $F_{SW}$ is a switching frequency of the digital regulator circuit.

According to an embodiment of the invention, when the output current decreases the unit current, the compensation circuit decreases the output voltage by the unit voltage to generate and output the feedback voltage. When the output current increases the unit current, the compensation circuit increases the unit voltage to the output voltage to generate and output the feedback voltage.

According to an embodiment of the invention, the compensation circuit includes a first current source, a second current source, a first switch, a second switch, a switch control unit, and a resistor, and the resistor is electrically connected between an input terminal of the compensation circuit and an output terminal of the compensation circuit, the first current source and the first switch are connected in series between a power supply terminal and the output terminal of the compensation circuit. The second switch and the second current source are connected in series between the output terminal of the compensation circuit and a ground terminal, and the switch control unit receives the current adjustment signal and controls the first switch and the second switch according to the current adjustment signal.

According to an embodiment of the invention, when the current adjustment signal indicates that the control unit respectively controls the plurality of current units to increase the unit current of the output current, the switch control unit controls the first switch to be turned on and the second switch to be turned off. When the current adjustment signal indicates that the control unit respectively controls the plurality of current units to decrease the output current by the unit current, the switch control unit controls the first switch to be turned off and the second switch to be turned on.

According to an embodiment of the invention, the compensation circuit includes a positive voltage source, a negative voltage source, a third switch, a fourth switch, and a switch control unit. The third switch is electrically connected between the positive voltage source and the positive input terminals of the first comparator and the second comparator. The fourth switch is electrically connected between the negative voltage source and the positive terminal of the first comparator and the positive input terminal of the second comparator. The negative input terminal of the first comparator receives the first reference voltage, and the negative input terminal of the second comparator receives the second reference voltage. When the current adjustment signal indicates that the control unit respectively controls the plurality of current units to increase the unit current to the output current, the switch control unit controls the third switch to be turned on and the fourth switch to be turned off. When the current adjustment signal indicates that the control unit respectively controls the plurality of current units to decrease the unit current to the output current, the switch control unit controls the third switch to be turned off and the fourth switch to be turned on. A positive voltage source provides a positive unit voltage, and a negative voltage source provides a negative unit voltage, the unit voltage satisfies the following conditions: $\Delta V>(V_{REF_H}-V_{REF_R})/2$, wherein $\Delta V$ is the unit voltage, $V_{REF_H}$ is a first reference voltage, and $V_{REF_R}$ is a second reference voltage.

In order to achieve the above aspects, a control method of a digital regulator system is provided. The digital regulator system includes a digital regulator circuit and a compensation circuit. The digital regulator circuit outputs an output current and an output voltage. The digital regulator circuit adjusts the output current according to a first reference voltage, a second reference voltage and a feedback voltage to decrease or increase a unit current of the output current. The control method includes the following steps: receiving the output voltage, and decreasing or increasing the output voltage by a unit voltage according to the variation of the output current to generate and output the feedback voltage, wherein the unit voltage satisfies the following conditions: $\Delta V>(V_{REF_H}-V_{REF_R})/2$, wherein $\Delta V$ is the unit voltage, $V_{REF_H}$ is the first reference voltage and $V_{REF_R}$ is the second reference voltage, wherein the first reference voltage is larger than the second reference voltage.

DETAILED DESCRIPTION

The implementation of the invention will be described in detail below with reference to the drawings and embodiments, so as to fully understand and implement how the invention applies technical means to solve technical problems and achieve technical effects.

Figure 1:
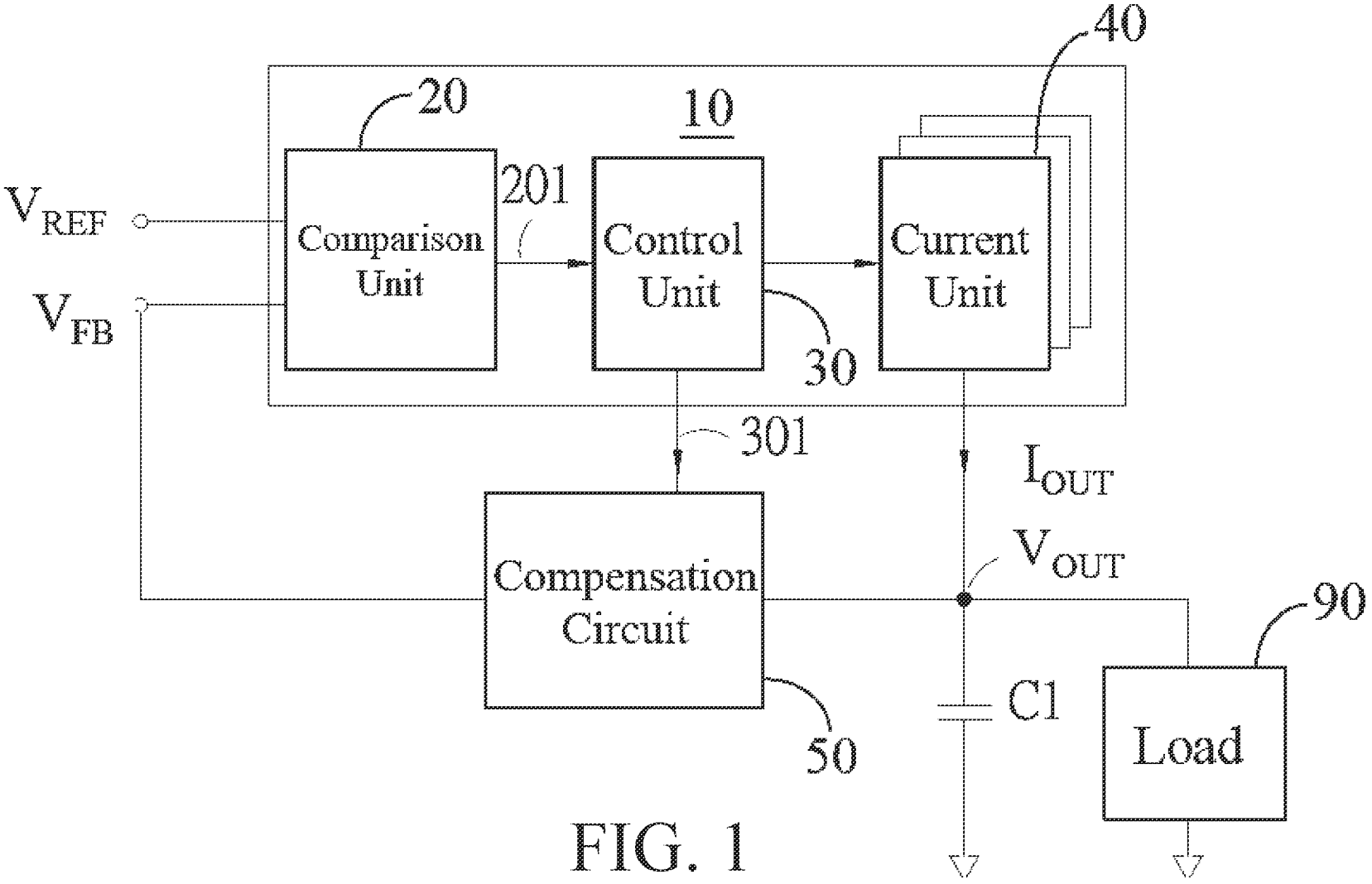
FIG. 1 is a block diagram of a digital regulator system according to an embodiment of the invention.

Referring to FIG. 1, which is a block diagram of a digital regulator system according to an embodiment of the invention. As shown in FIG. 1, the digital regulator system may include a digital regulator circuit 10 and a compensation circuit 50. The digital regulator circuit 10 includes at least a comparison unit 20, a control unit 30 and a plurality of current units 40. Each current unit 40 can provide a unit current, and the control unit 30 controls the on state of the plurality of current units 40, so that an output current $I_{OUT}$ and an output voltage $V_{OUT}$ are generated on the output terminal of the digital regulator circuit 10. The output terminal of the digital regulator circuit 10 is further electrically connected to a capacitor C1 and a load 90.

For example, when the control unit 30 turns on two current units 40 and turns off the other current units 40, the output current $I_{OUT}$ is twice the unit current; the control unit 30 turns on five current units 40 and turns off the other current units 40, the output current $I_{OUT}$ is five times the unit current. Hence, the variation in the output current $I_{OUT}$ is based on the unit current.

The compensation circuit 50 is electrically connected to the output terminal of the digital regulator circuit 10, receives the output voltage $V_{OUT}$, and decreases or increases the unit voltage according to the variation of the output current $I_{OUT}$ to generate and output the feedback voltage $V_{FB}$. The comparison unit 20 compares at least one reference voltage $V_{REF}$ and the feedback voltage $V_{FB}$ to generate a comparison result. The control unit 30 can adjust the output current $I_{OUT}$ according to the comparison result 201 to decrease or increase the unit current by the output current $I_{OUT}$.

For example, the unit voltage can be 0.5 V. When the output current $I_{OUT}$ is increased by one unit current, the compensation circuit 50 increases the output voltage $V_{OUT}$ to 0.5 V to generate the feedback voltage $V_{FB}$. When the output current $I_{OUT}$ is increased by one unit current, the compensation circuit 50 decreases 0.5 V from the output voltage $V_{OUT}$ to generate the feedback voltage $V_{FB}$. The compensation circuit 50 adjusts the feedback voltage $V_{FB}$ according to the variation of the output current $I_{OUT}$, the convergence stability of the digital regulator circuit 10 can be improved.

Figure 2:
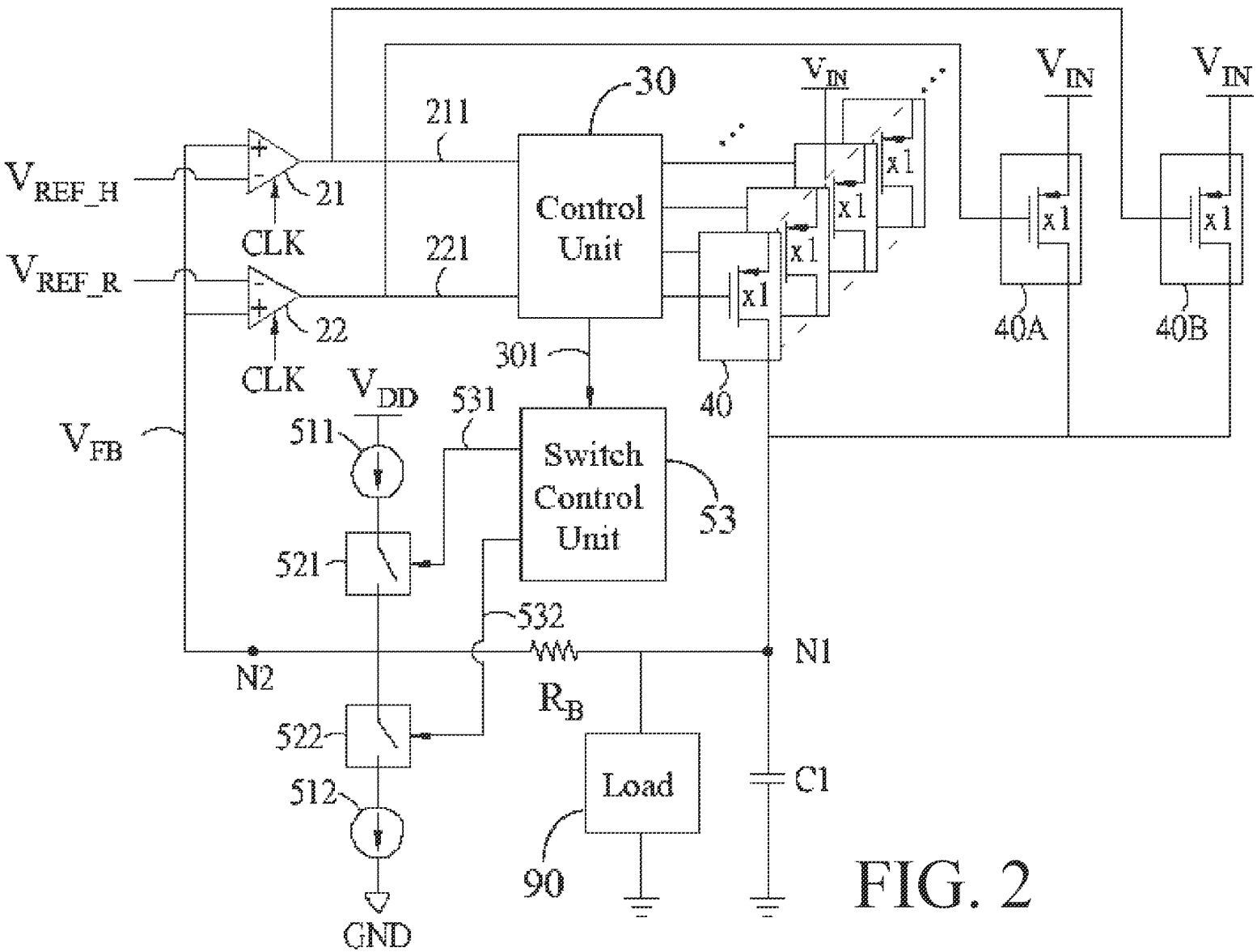
FIG. 2 is a schematic circuit diagram of a digital regulator system according to another embodiment of the invention.

Referring to FIG. 2, which is a schematic circuit diagram of a digital regulator system according to another embodiment of the invention. As shown in FIG. 2, the digital regulator circuit may include a first comparator 21, a second comparator 22, a control unit 30, and a plurality of current units 40, 40A, and 40B. An output terminal N1 of the digital regulator circuit is coupled to a capacitor C1 and a load 90.

When each current unit 40A is turned on, a unit current $\Delta I$ can be output. The negative input terminal of the first comparator 21 receives the first reference voltage $V_{REF_H}$, and the positive input terminal receives a feedback voltage $V_{FB}$. The first comparator 21 compares the first reference voltage $V_{REF_H}$ and the feedback voltage $V_{FB}$ to generate a comparison result 211. The negative input terminal of the second comparator 22 receives the second reference voltage $V_{REF_R}$, and the positive input terminal receives the feedback voltage $V_{FB}$. The first reference voltage $V_{REF_H}$ is greater than the second reference voltage $V_{REF_R}$. The second comparator 22 compares the second reference voltage $V_{REF_R}$ and the feedback voltage $V_{FB}$ to generate a comparison result 221. The first comparator 21 and the second comparator 22 receive a clock signal CLK and periodically perform the comparison according to the clock signal CLK. It should be noted that two comparators are used in this embodiment, but the invention is not limited thereto; in other embodiment, the digital regulator system can use only one comparator to compare the feedback voltage $V_{FB}$ with a reference voltage, to generate a comparison result for further use in controlling the current units.

The control unit 30 can respectively turn on or turn off the plurality of current units 40 according to the comparison results 211 and 221. The sum of the unit currents outputted by all the turned-on current units 40 generates an output current $I_{OUT}$ flowing through the output terminal N1 of the digital regulator circuit.

The control unit 30 outputs a current adjustment signal 301, which indicates that the control unit 30 respectively turns on or turns off the plurality of current units 40 to increase or decrease the unit current by the output current $I_{OUT}$. In this embodiment, the compensation circuit includes a first current source 511, a second current source 512, a first switch 521, a second switch 522, a switch control unit 53, and a resistor $R_B$. The resistor $R_B$ is electrically connected between an input terminal of the compensation circuit and an output terminal N2, and the input terminal of the compensation circuit is electrically connected to the output terminal N1 of the digital regulator circuit.

The first current source 511 and the first switch 521 are connected in series between a power supply terminal $V_{DD}$ and the output terminal N2 of the compensation circuit 50, and the current output terminal of the first current source 511 is electrically connected to the first switch 521. The second switch 522 and the second current source 512 are connected in series between the output terminal of the compensation circuit 50 and a ground terminal GND, and the current output terminal of the second current source 512 is electrically connected to the second switch 522.

The switch control unit 53 receives the current adjustment signal 301 and controls the first switch 521 and the second switch 522 according to the current adjustment signal 301. Through the above structure, the compensation circuit 50 can decrease or increase the output voltage $V_{OUT}$ by a unit voltage ΔV according to the current adjustment signal 301 to generate and output the feedback voltage $V_{FB}$.

In an embodiment, when the unit voltage ΔV satisfies the following conditions: $\Delta V>(V_{REF_H}-V_{REF_R})/2$, the convergence stability of the digital regulator circuit can be effectively improved.

In an embodiment, the unit current ΔI may satisfy the following conditions: $\Delta I>(V_{REF_H}-V_{REF_R})\times C_p\times F_{SW}$, wherein Cp is a capacitance value of the capacitor C1, and $F_{SW}$ is a voltage regulator circuit A switching frequency can effectively improve the convergence stability of the digital regulator circuit.

The detailed operation of the compensation circuit of this embodiment is explained below. When the switch control unit 53 determines that the control unit 30 decides to turn on one more current unit according to the current adjustment signal 301 to increase the output current $I_{OUT}$ by a unit current ΔI, the switch control unit 53 turns on the first switch 521 and turns off the second switch 522, so that the current of the first current source 511 flows to the output terminal N2 of the compensation circuit. Since the input impedance of the first comparator 21 and the second comparator 22 are much greater than that of the resistor $R_B$, the current of the first current source 511 flows through the resistor $R_B$ and flows to the output terminal N1 of the digital regulator circuit.

Since the current flows from the output terminal N2 of the compensation circuit to the input terminal of the compensation circuit via the resistor $R_B$, the voltage of the output terminal N2 of the compensation circuit is higher than the output voltage $V_{OUT}$ of the digital regulator circuit. In other words, the compensation circuit 50 correspondingly increases a unit voltage ΔV to the output voltage $V_{OUT}$ to generate and output the feedback voltage $V_{FB}$. The unit voltage ΔV is the voltage across the resistor $R_B$.

When the switch control unit 53 determines that the control unit 30 decides to turn off one more current unit according to the current adjustment signal 301, the output current $I_{OUT}$ decreases by a unit current ΔI, the switch control unit 53 turns on the second switch 522 and turns off the first switch 521, the current of the second current source 512 flows from the output terminal N2 of the compensation circuit to the ground terminal GND. Because of the input impedance of the first comparator 21 and the second comparator 22 are much greater than that of the resistor $R_B$, the current of the second current source 512 flows from the output terminal N1 of the digital regulator circuit through the resistor $R_B$, and flows to the output terminal N2 of the compensation circuit.

Since the current flows from the input terminal N1 of the compensation circuit to the output terminal of the compensation circuit via the resistor $R_B$, the voltage of the output terminal N1 of the compensation circuit is lower than the output voltage $V_{OUT}$ of the digital regulator circuit. In other words, the compensation circuit 50 correspondingly decreases the output voltage $V_{OUT}$ by a unit voltage ΔV to generate and output the feedback voltage $V_{FB}$.

Figure 3:
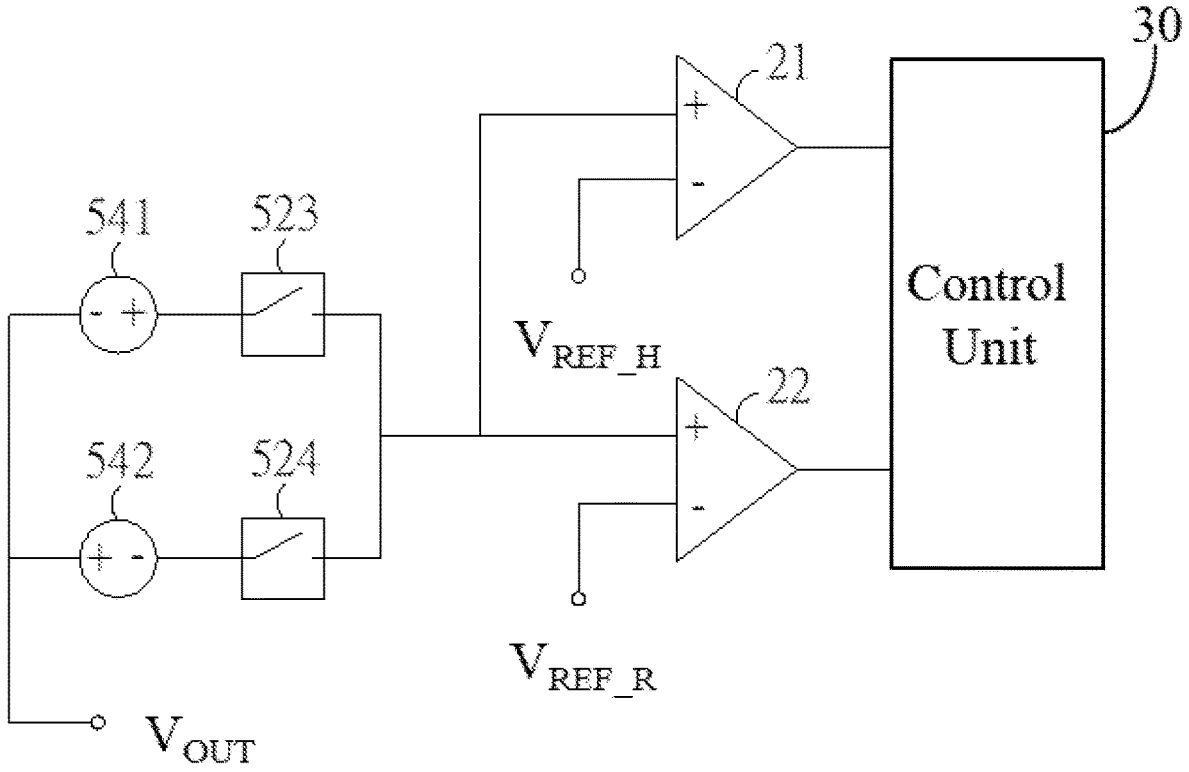
FIG. 3 is a schematic circuit diagram of a digital regulator system according to yet another embodiment of the invention.

Referring to FIG. 3, which is a schematic circuit diagram of the digital regulator system according to yet another embodiment of the invention. As shown in FIG. 3, the compensation circuit 50 includes a positive voltage source 541, a negative voltage source 542, a third switch 523, a fourth switch 524, and a switch control unit 53. The third switch 523 is electrically connected between the positive voltage source 541 and the positive input terminals of the first comparator 21 and the second comparator 22. The fourth switch 524 is electrically connected between the negative voltage source 542 and the positive input terminals of the first comparator 21 and the second comparator 22. The negative input terminal of the first comparator 21 receives the first reference voltage $V_{REF_H}$, and the negative input terminal of the second comparator 22 receives the second reference voltage $V_{REF_R}$. One end of the positive voltage source 541 is electrically connected to the third switch 523, and the other end is electrically connected to the output terminal N1 of the digital regulator circuit and receives the output voltage $V_{OUT}$. One end of the negative voltage source 542 is electrically connected to the fourth switch 524, and the other end is electrically connected to the output terminal N1 of the digital voltage regulator, and receives the output voltage $V_{OUT}$.

The positive voltage source 541 provides a positive unit voltage ΔV, and the negative voltage source 542 provides a negative unit voltage ΔV, and the unit voltage ΔV satisfies the following condition: $\Delta V>(V_{REF_H}-V_{REF_R})/2$.

The switch control unit 53 is used to turn on or turn off the third switch 523 and the fourth switch 524. When the switch control unit 53 determines that the control unit 30 decides to turn on one more current unit according to the current adjustment signal 301 to increase the output current $I_{OUT}$ by a unit current ΔI, the switch control unit 53 turns on the third switch 523 and turns off the fourth switch 524. Therefore, the output voltage $V_{OUT}$ pluses the unit voltage ΔV is input to the positive input terminal of the first comparator 21 and the second comparator 22.

When the switch control unit 53 determines that the control unit 30 decides to turn off one more current unit according to the current adjustment signal 301 to decrease the output current $I_{OUT}$ by a unit current ΔI, the switch control unit 53 turns off the third switch 523 and turns on the fourth switch 524. Therefore, output voltage $V_{OUT}$ minuses unit voltage ΔV and then is input to the positive input terminals of the first comparator 21 and the second comparator 22.

Therefore, when the unit voltage ΔV is larger than half of the sum of the first reference voltage and the second reference voltage, the feedback voltage $V_{FB}$ increases or decreases a unit voltage ΔV according to the output current, so that the digital regulator circuit can effectively improve convergence stability.

Figure 4:
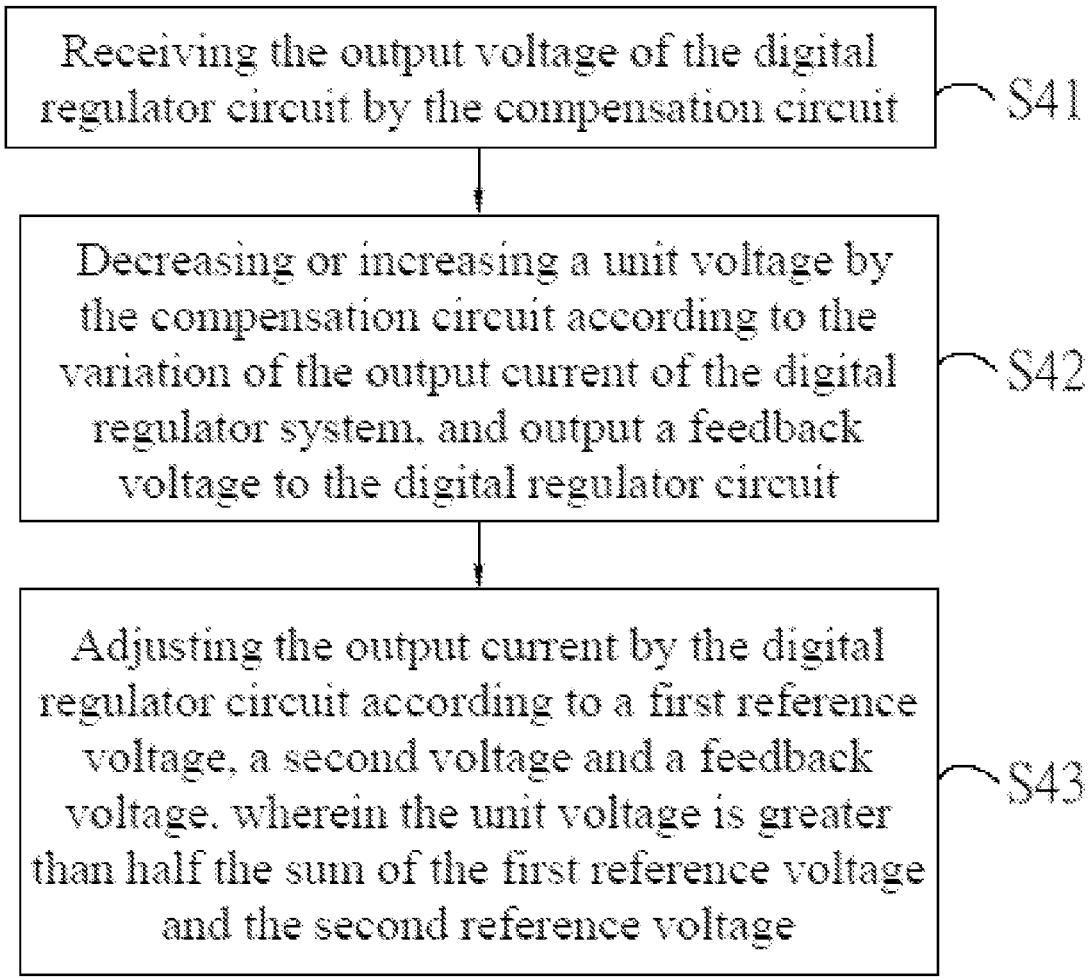
FIG. 4 is a flowchart of a control method of a digital regulator system according to an embodiment of the invention.

Referring to FIG. 4, which is a flowchart of a control method of the digital regulator system according to an embodiment of the invention. The control method is applied for a digital regulator circuit, which outputs an output current and an output voltage, and the output current is changed by decreasing or increasing a unit current. This control method includes steps S41 to S43. In step S41, a compensation circuit is used to receive the output voltage. In step S42, the compensation circuit decreases or increases the output voltage $V_{OUT}$ by a unit voltage according to the variation of the output current to generate and output the feedback voltage to the digital regulator circuit. In step S43, the digital regulator circuit adjusts the output current according to the first reference voltage, the second reference voltage, and the feedback voltage, wherein the unit voltage is greater than half of the sum of the first reference voltage and the second reference voltage, thereby improving the convergence stability of the digital regulator circuit.

Although the invention is disclosed in the foregoing embodiments as above, it is not intended to limit the invention. A person skilled in the art can make some modifications and retouches without departing from the spirit and scope of the invention. The patent protection scope of the invention shall be determined by the scope of the patent application claims attached to the specification.

What is claimed is:

1. A digital regulator system, comprising:

a digital regulator circuit outputting an output current and an output voltage, and comprising a plurality of current units, wherein each of the plurality current units outputs the unit current when being turned on, and the digital regulator circuit is configured to turn on or turn off at least one of the plurality of current units to adjust the output current by decreasing or increasing a unit current according to at least a reference voltage and a feedback voltage; and a compensation circuit receiving the output voltage, and decreasing or increasing the output voltage by a unit voltage to generate and output the feedback voltage according to a variation of the output current;

wherein the compensation circuit decreases the unit voltage for the output voltage to generate and output the feedback voltage when the output current decreases the unit current;

wherein the compensation circuit increases the unit voltage for the output voltage to generate and output the feedback voltage when the output current increases the unit current.

2. The digital regulator system of claim 1, wherein the digital regulator circuit further comprises:

a first comparator;

a second comparator; and a control unit configured to turn on or turn off at least one of the plurality of current units according to comparison results generated by the first comparator and the second comparator, so as to output at least one unit current to generate the output current.

3. The digital regulator system of claim 2, wherein the control unit outputs a current adjustment signal to the compensation circuit, and the compensation circuit decreases or increases the output voltage by the unit voltage according to the current adjustment signal, so as to generate and output the feedback voltage, wherein the current adjustment signal indicates that the control unit turns on or turns off at least one of the plurality of current units to increase or decrease the output current by the unit current.

4. The digital regulator system of claim 3, wherein the compensation circuit comprises a first current source, a second current source, a first switch, a second switch, a switch control unit and a resistor;

wherein the resistor is electrically connected between an input terminal and an output terminal of the compensation circuit, and the first current source and the first switch are connected in series between a power supply terminal and the output terminal of the compensation circuit, and the second switch and the second current source are connected in series between the output terminal of the compensation circuit and a ground terminal, the switch control unit receives the current adjustment signal, and controls the first switch and the second switch according to the current adjustment signal.

5. The digital regulator system of claim 4, wherein the switch control unit respectively controls the first switch to be turned on and controls the second switch to be turned off when the current adjustment signal indicates that the control unit controls the plurality of current units to increase the output current by the unit current;

wherein the switch control unit controls the first switch to be turned off and controls the second switch to be turned on when the current adjustment signal indicates that the control unit respectively controls the plurality of current units to decrease the output current by the unit current.

6. The digital regulator system of claim 2, wherein the positive input terminal of the first comparator receives the feedback voltage, and the negative input terminal of the first comparator receives a first reference voltage, and the positive input terminal of the second comparator receives the feedback voltage, and the negative input terminal of the second comparator receives a second reference voltage, and the first reference voltage is larger than the second reference voltage.

7. The digital regulator system of claim 6, wherein the unit voltage satisfies the following conditions:

$$\Delta V > (V_{REF_H} - V_{REF_R})/2;$$

wherein ΔV is the unit voltage, and the $V_{REF_H}$ is the first reference voltage, and the $V_{REF_R}$ is the second reference voltage.

8. The digital regulator system of claim 6, wherein an output terminal of the digital regulator circuit is coupled to a capacitor, and the unit current satisfies the following conditions:

$$\Delta I > (V_{REF_H} - V_{REF_R}) \times C_p \times F_{SW};$$

wherein ΔI is the unit current, and the $V_{REF_H}$ is the first reference voltage, and the $V_{REF_R}$ is the second reference voltage, and the $C_p$ is a capacitance value of the capacitor, $F_{sw}$ is a switching frequency of the digital regulator circuit.

9. The digital regulator system of claim 1, wherein the compensation circuit comprises a positive voltage source, a negative voltage source, a third switch, a fourth switch and a switch control unit;

wherein the third switch is electrically connected between the positive voltage source as well as the positive input terminal of the first comparator and the positive input terminal of the second comparator, the fourth switch is electrically connected between the negative voltage source as well as the positive input terminal of first comparator and the positive input terminal of the second comparator, and the negative input terminal of the first comparator receives the first reference voltage, and the negative input terminal of the second comparator receives the second reference voltage;

wherein the switch control unit controls the third switch to be turned on and controls the fourth switch to be turned off when the current adjustment signal indicates that the control unit respectively controls the plurality of current units to increase the unit current for the output current;

wherein the switch control unit controls the third switch to be turned off and controls the fourth switch to be turned on when the current adjustment signal indicates that the control unit controls the plurality current units respectively to decrease the unit current for the output current;

wherein the positive voltage source provides a unit voltage being positive, and the negative voltage source provides a unit voltage being negative, and the unit voltage satisfies the following conditions:

$$\Delta V>(V_{REF_H}-V_{REF_R})/2$$

wherein $\Delta V$ is the unit voltage, and the $V_{REF_H}$ is the first reference voltage, and the $V_{REF_R}$ is the second reference voltage.

10. A control method of a digital regulator system comprising a digital regulator circuit and a compensation circuit, wherein the digital regulator circuit outputs an output current and an output voltage, and the digital regulator circuit adjusts the output current to decrease or increase by a unit current according to a first reference voltage, a second reference voltage and a feedback voltage, wherein the control method comprises:

receiving the output voltage, and decreasing or increasing a unit voltage to generate and output the feedback voltage according to the variation of the output current;

wherein the unit voltage satisfies the following conditions:

$$\Delta V>(V_{REF_H}-V_{REF_R})/2;$$

wherein $\Delta V$ is the unit voltage, the $V_{REF_H}$ is the first reference voltage, and the $V_{REF_R}$ is the second reference voltage, wherein the first reference voltage is larger than the second reference voltage.

11. A control method of a digital regulator system comprising a digital regulator circuit and a compensation circuit, wherein the digital regulator circuit outputs an output current and an output voltage, and the digital regulator circuit adjusts the output current to decrease or increase by a unit current according to a first reference voltage, a second reference voltage and a feedback voltage, wherein the control method comprises:

receiving the output voltage, and decreasing or increasing the output voltage by a unit voltage to generate and output the feedback voltage according to the variation of the output current;

wherein the compensation circuit decreases the unit voltage for the output voltage to generate and output the feedback voltage when the output current decreases the unit current;

wherein the compensation circuit increases the unit voltage for the output voltage to generate and output the feedback voltage when the output current increases the unit current.

* * * * *